United States Patent [19]

Balkcom

[11] 4,052,060

[45] Oct. 4, 1977

[54] BREAK DOWN GAME RACKET

[75] Inventor: Robby P. Balkcom, Maywood, Ill.

[73] Assignee: Lawrence Peska Assoc. Inc., New York, N.Y. ; a part interest

[21] Appl. No.: 680,852

[22] Filed: Apr. 27, 1976

[51] Int. Cl.[2] ..... A63B 49/02

[52] U.S. Cl. ..... 273/73 R; 273/73 G

[58] Field of Search ..... 273/73 R, 73 C, 73 G, 273/73 H, 73 J, 80 R, 80 D, 80.1, 80.2, 81.2; 85/3 R; 280/603; 403/315, 320, 325, 326, 378–380; 294/65.5; 135/75, 76

[56] References Cited

U.S. PATENT DOCUMENTS

| | | | |
|---|---|---|---|
| 1,548,134 | 8/1925 | Gallaudet | 273/73 J X |
| 1,897,515 | 2/1933 | Hedstrom | 273/73 J X |
| 2,077,804 | 4/1937 | Morrison | 85/3 R X |
| 2,221,288 | 11/1940 | Okun | 403/378 X |
| 2,660,083 | 11/1953 | Tyson | 85/3 R X |
| 2,911,985 | 11/1959 | Granrath | 135/75 |
| 3,104,757 | 9/1963 | Dougherty et al. | 403/379 X |
| 3,207,010 | 9/1965 | Wendling | 294/65.5 X |

FOREIGN PATENT DOCUMENTS

| | | | |
|---|---|---|---|
| 929,872 | 7/1947 | France | 135/76 |
| 1,903,722 | 8/1970 | Germany | 273/73 C |

*Primary Examiner*—Richard J. Apley

[57] ABSTRACT

A break down game racket for playing tennis, squash, badminton and the like is disclosed comprising a game racket head and a game racket handle detachably securably to one another through handle securing means comprising sections of the racket head and the racket handle that overlap one another and have openings therein registerable with one another, the openings having a longitudinal axis that is transverse to a plane passing through the longitudinal axis of the handle and the racket head.

8 Claims, 3 Drawing Figures

BREAK DOWN GAME RACKET

DETAILED DESCRIPTION

The present invention relates to a game racket comprising a racket head, a racket handle and a handle securing section comprising:

1. a handle receiving member in the racket head
2. one end of the handle being detachably and overlappingly securable to the handle receiving member.

Registerable openings are provided in the receiving member and the handle where the handle and the receiving member overlap, the longitudinal axis of the opening passing transversely through a plane lying in the longitudinal axis of the handle, a securing member such as a pin being insertable through the openings.

In a further embodiment, the pin has means thereon for releasaly locking the pin in the opening. The means for releasably locking the pin in the opening in one embodiment comprise arms pivotally secured to one end of the pin, to swing in a plane passing through the longitudinal axis of the pin. A recess member is provided in the handle secruing member to receive and secure the arms. the recess member may comprise an arm-shaped slot into which the arms may be pivotally extended. The arms may be magnetically held in the recess by means of magnets attached to either the arms and/or the handle securing member. Either the handle securing member or the arms may comprise a magnetic member and the other fabricated from a metal that is magnetizable such as iron and the like.

The pin and the opening may be threaded so that the opening threadably receives the pin. Additionally, detent means are provided in the handle securing member for detachably securing the handle to the frame.

In another embodiment, the handle securing member comprises a first set of planar walls intersecting one another in the handle receiving member and extending in a direction towards the handle and a second set of mating planar walls on the said one end of the handle for slidably engaging the first set of planar walls.

DETAILED DESCRIPTION

A breakdown game racket is disclosed in U.S. Pat. No. 3,833,218, Frenkel, et al. The Frenkel racket consists of a head and a handle detachaly connected to the head at a throat. The handle has at least one partially threaded bolt axially extending the length of the handle with the threaded portion extending beyond one end thereof. An internally threaded insert is carried by the throat for receiving the bolt so that the handle may be secured to and detached from the head. Guide members are provided on the handle for engagement with the throat so that the handle is properly aligned with the head. A grip expanding member is carried within a partially hollow handle to vary the diameter of the handle. The Frenkel et al. game racket guide members comprise extensions projecting from the handle into the racket head. Additionally the Frenkel et al. racket does not disclose means for locking the bolt in place and furthermore employs a bolt axially extending the length of the handle.

Other tennis rackets known in the prior art are disclosed in U.S. Pat. Nos. 3,679,205 Finkle; 1,832,298 Greenspan and 1,808,035 Guenard.

It is therefore an object of the present invention to provide an improved break down game racket.

It is a further object of the present invention to provide a breakdown game racket that is easily assembled and aligned and in which the handle and the head thereof are secured together by lightweight locking securing members.

These and other objects have been achieved according to the present invention and will become aparent from the disclosure and claims that follow as well as the appended drawing.

Figure 1:
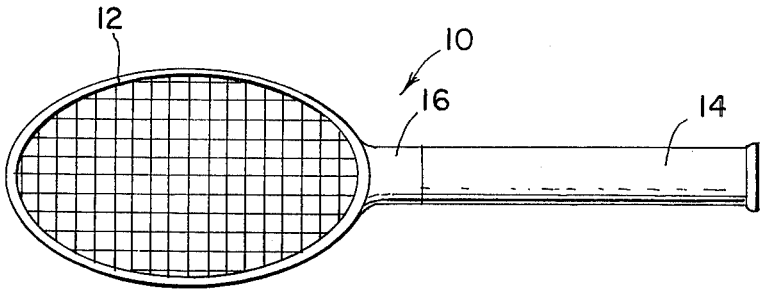
FIG. 1 is a plan view illustrating a break down game racket according to one embodiment of the present invention.
Figure 2:
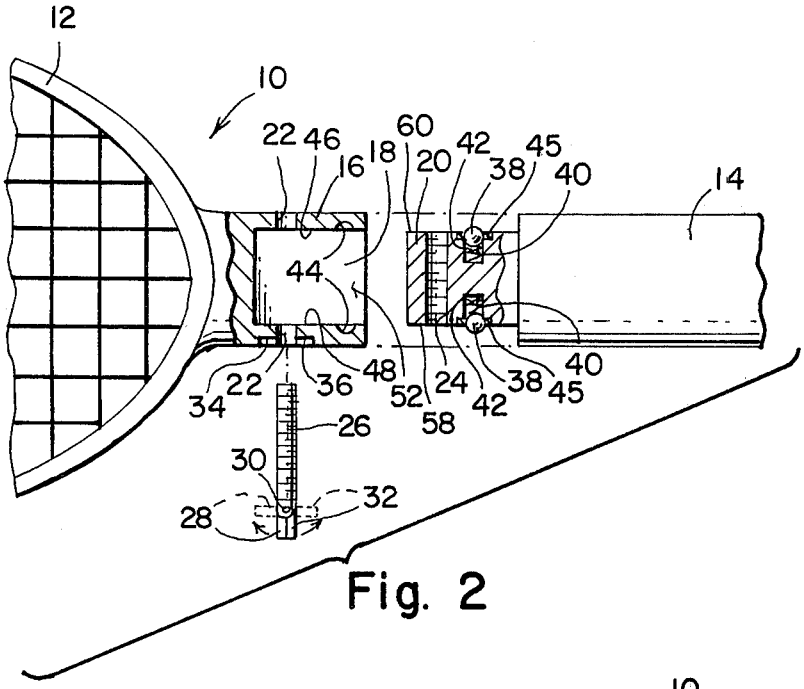
FIG. 2 is an exploded partial plan view partially in section illustrating a breakdown game racket according to one embodiment of the present invention.
Figure 3:
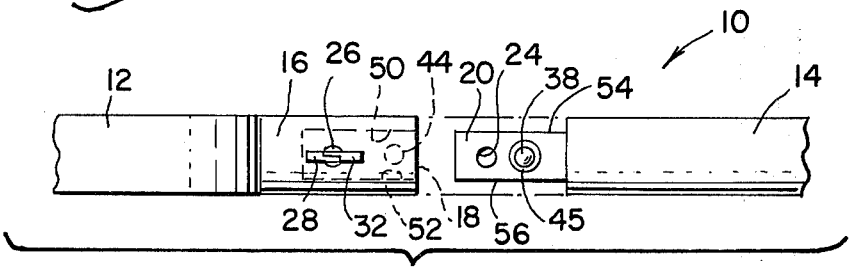
FIG. 3 is an exploded partial side elevtion in section (partial side elevation) of a breakdown racket according to another embodiment of the present invention.

Referring to FIGS. 1–3 in the drawing, a breakdown game racket 10 is illustrated such as a breakdown tennis racket, badminton racket or squash racket. The racket comprises a racket head 12 and a racket handle 14 attachable thereto through handle securing means comprising a handle receiving member 16 extending from the head 12, the other portion of the handle securing member comprising an end 20 of handle 14 detachably and overlappingly securable to handle receiving member 16. End 20 is insertable into opening 18 in handle receiving member 16. An opening 22 is provided in handle receiving member 16, opening 22 being registerable with opening 24 in the end 20 of handle 14.

Opening 22 is registerable with opening 24 when the handle receiving member 16 and the end 20 of the handle 14 overlap. The longitudinal axis of the openings 22 and 24 pass transversely through a plane lying in the longitudinal axis of the handle 14. A securing member comprising pin 26 is insertable in openings 22 and 24, pin 26 in one embodiment comprising a threaded pin, opening 24 comprising a threaded opening so that threaded pin 26 is threadably received by opening 24. Arm members 28 and 32 are pivotally secured to one end of pin 26 through pivot 30 for releasably locking pin 26 in the openings 22 and 24, arms 28 and 32 being positioned to swing in a plane passing through the longitudinal axis of pin 26. Recess 34 and 36 is provided in handle receiving member 16 to receive and secure arms 28 and 32 and thereby lock pin 26 in opening 22 and 24. Recess 34 and recess 36 in one embodiment comprises arm-shaped slots into which the arms 28 and 32 may be pivotally extended. Arms 28 and 32 may be resiliently biased inwardly toward the longitudinal axis of pin 26 into recesses or slots 34 and 36 or arms 28 and 32 may be secured in recess or slots 34 and 36 by magnetic means. In the latter embodiment, arms 28 and 32 may be fabricated from a magnetic material such as an aluminum-nickel-cobalt magnetic composition and handle receiving member may comprise a magnetizable metal such as an iron alloy, e.g., stainless steel or other lightweight iron-based alloy material or magnetizable material. Detents are provided on the end 20 of handle 14 such as a ball-bearing 38 resiliently biased in opening 40 by means of coil spring 42 into a washer 45 the diameter of which is less than the diameter of ball 38, washer 45 being secured in the end of opening 40. Ball bearing 38 is receivied in a domed opening 44 in the handle receiving section 16, the detent members in one embodiment comprising opposed detent openings 44 and opposed ball members 38.

In use, the handle 14 may be removed from the head 12 of the racket 10 by swinging the arms 28 and 32 outwardly of openings 34 and 36 in handle receiving section 16 and turning the pin 26 to unscrew such pin from the threaded opening 24 in end 20 of handle 14. When the pin 26 is removed, handle section 14 is removed from the head 12 and the racket may then be transported readily without any ungainly protrusions. Additionally, the present invention affords means for using a single handle with any of a plurality of heads whether the heads are wooden, aluminum, steel or the like and similarly a single head can be used with any of a plurality of handles so that the player using the game racket if accustomed to either one handle or one head can then switch the other part of the racket to suit his game accordingly.

In one embodiment the handle securing member comprising end 20 and handle receiving member 16 comprise a first set of planar walls such as the four walls 46, 48, 50 and 52 illustrated in FIGS. 2 and 3 in which the walls intersect one another in the handle receiving member and extend in a direction towards the handle 14, a second set of mating planar walls comprising walls 54, 56, 58 and 60 intersecting one another for slidably engaging the first set of planar walls. This construction avoids the guide members required according to the disclosure of U.S. Pat. No. 3,833,218 Frenkel et al and readily provides means for aligning and holding the handle 14 in alignment with the head 12. Although the securing member comprises a first set of four planar walls and a second set of four mating planar walls slidably engaging one another, in its broadest aspect these mating planar walls may comprise either a first set of three and a second set of three walls, a first set of four and a second set of four planar walls, a first set of five and a second set of five planar walls and so forth, this aspect of the invention being subject to modification according to the broad scope in which guide members are obviated by providing planar walls in lieu thereof slidably engageable with one another.

Although the invention has been described by reference to some embodiments it is not intended that the novel breakdown racket be limited thereby but that modifications thereof are intended to be included as falling within the broad scope and spirit of the foregoing disclosure the following claims and the appended drawing.

What is claimed is:

1. A game racket comprising racket head means, detachable handle means and handle securing section comprising:

1. handle receiving means in said head and
2. one end of said handle means detachably and overlappingly securable to said handle receiving means,
3. registerable opening means in said receiving means and said handle where said handle and said receiving means overlap, the longitudinal axis of said opening means passing transversely through a plane lying in the longitudinal axis of said handle,
4. securing means in said handle comprising pin means, arm means pivotally secured to one end of said pin means to swing in a plane passing through the longitudinal axis of said pin means, recess means in said handle securing means to pivotally receive and secure said arm means.

2. The game racket of claim 1 where said recess means comprise arm shaped slots into which said arm means may be pivotally extended.

3. The game racket of claim 2 where said arm means are magnetically held in said slots.

4. The game racket of claim 3 further comprising thread means on said pin and thread means in said opening for threadably receiving said pin.

5. The game racket of claim 1 where said arm means are magnetically held in said recess.

6. The game racket of claim 5 further comprising thread means on said pin and thread means in said opening for threadably receiving said pin.

7. The game racket of claim 1 further comprising detent means in said handle securing means for detachably securing said handle to said frame.

8. The game racket of claim 1 where said handle securing means comprises a first set of planar walls intersecting one another in said handle receiving means and extend in a direction towards said handle and a second set of mating planar walls intersecting one another on said one end of said handle for slidably engaging said first set of planar walls.

* * * * *